US010018101B2

(12) United States Patent
Seligman

(10) Patent No.: US 10,018,101 B2
(45) Date of Patent: Jul. 10, 2018

(54) COOLING SYSTEM AND A METHOD FOR ITS USE

(71) Applicant: Robert D. Seligman, Newtown, PA (US)

(72) Inventor: Robert D. Seligman, Newtown, PA (US)

( * ) Notice: Subject to any disclaimer, the term of this patent is extended or adjusted under 35 U.S.C. 154(b) by 410 days.

(21) Appl. No.: 14/156,940

(22) Filed: Jan. 16, 2014

(65) Prior Publication Data

US 2014/0202660 A1 Jul. 24, 2014

Related U.S. Application Data

(60) Provisional application No. 61/754,198, filed on Jan. 18, 2013.

(51) Int. Cl.
*F28F 9/26* (2006.01)
*F01P 3/18* (2006.01)

(52) U.S. Cl.
CPC ..... *F01P 3/18* (2013.01); *F01P 2003/185* (2013.01)

(58) Field of Classification Search
CPC .... F28D 1/0452; F28D 1/0435; F28D 1/0417; F28D 1/05308; F28D 1/05358; F28D 1/0408; F28D 2001/026; F28D 2001/0266; F28F 9/0263; F28F 9/0282; F28F 9/0246; F28F 9/001; F28F 2009/004; F28F 9/0248; F28F 9/262; B60K 11/06; F01P 2003/185; F01P 3/18
USPC ..... 123/41.29, 41.51; 165/140, 144, 175
See application file for complete search history.

(56) References Cited

U.S. PATENT DOCUMENTS 1,404,005 A * 1/1922 Berman ..... F28D 1/0535 165/149
1,558,009 A * 10/1925 Giesler ..... F01P 7/16 123/41.1
1,899,629 A * 2/1933 Morse ..... F28D 1/0535 165/134.1
1,915,805 A * 6/1933 Sutcliffe ..... F28D 1/05333 165/137
1,930,387 A * 10/1933 Guernsey ..... F01P 3/20 123/41.29
1,958,226 A * 5/1934 Askin ..... F25B 39/04 165/149
2,147,719 A 2/1939 Simons
2,336,840 A 12/1943 Brehob
2,597,061 A 5/1952 Burich
2,778,606 A * 1/1957 Lloyd ..... F28F 1/02 165/149
3,425,400 A 2/1969 Scherenberg
4,387,670 A 6/1983 Robin et al.
(Continued)

*Primary Examiner* — Jianying Atkisson
*Assistant Examiner* — Jose O Class-Quinones
(74) *Attorney, Agent, or Firm* — Muskin & Farmer, LLC

(57) ABSTRACT

A cooling system that has a primary radiator with a first stepped tank and a second stepped tank. These stepped tanks have openings which allow the primary radiator to connect to one or more supplemental radiators so that coolant may flow through these radiators simultaneously thus increasing a vehicle's cooling capacity. Flow of coolant between the primary radiator and the supplemental radiators can be controlled by either automatic or manual control valves and wherein the primary radiator and supplemental radiator can be either down-flow radiators or cross-flow radiators.

19 Claims, 13 Drawing Sheets

(56) References Cited

U.S. PATENT DOCUMENTS

| | | | | |
|---|---|---|---|---|
| 4,431,133 | A * | 2/1984 | Roberson, Sr. | F01P 7/16 137/522 |
| 4,757,858 | A | 7/1988 | Miller et al. | |
| 4,953,631 | A * | 9/1990 | Kimura | B60K 11/04 123/41.51 |
| 5,074,254 | A * | 12/1991 | Takamatsu | F01P 3/02 123/2 |
| 5,176,111 | A * | 1/1993 | Nakamura | B62K 11/00 123/41.01 |
| 5,529,116 | A * | 6/1996 | Sasaki | F28D 1/0417 123/41.51 |
| 5,927,390 | A | 7/1999 | Lehman | |
| 6,422,182 | B1 * | 7/2002 | Ohta | B60K 11/04 123/41.29 |
| 7,128,178 | B1 | 10/2006 | Heinle et al. | |
| 7,261,068 | B1 | 8/2007 | Wantschik | |
| 7,464,781 | B2 | 10/2008 | Guay et al. | |
| 2001/0017201 | A1 * | 8/2001 | Avequin | F28F 9/0224 165/173 |
| 2003/0116308 | A1 * | 6/2003 | Watanabe | F28D 1/05366 165/144 |
| 2005/0081534 | A1 * | 4/2005 | Suzuki | F28D 1/05366 62/50.2 |
| 2009/0301411 | A1 * | 12/2009 | Iwasaki | B60H 1/00328 123/41.23 |
| 2009/0314266 | A1 * | 12/2009 | Hori | F01P 7/165 123/568.12 |
| 2011/0139418 | A1 * | 6/2011 | Pustelnik | F28D 1/05366 165/170 |

* cited by examiner

FIG. 19
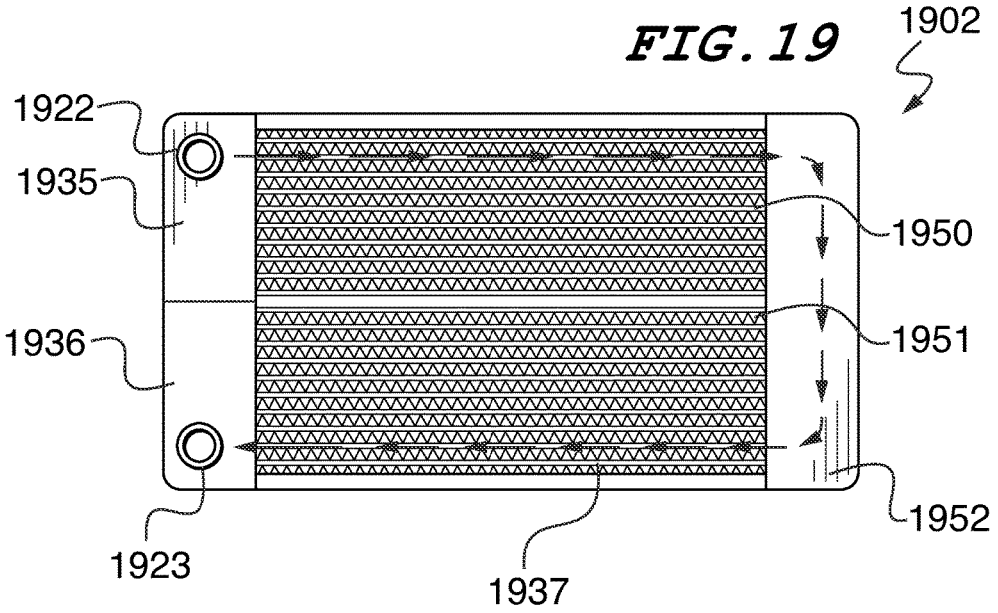
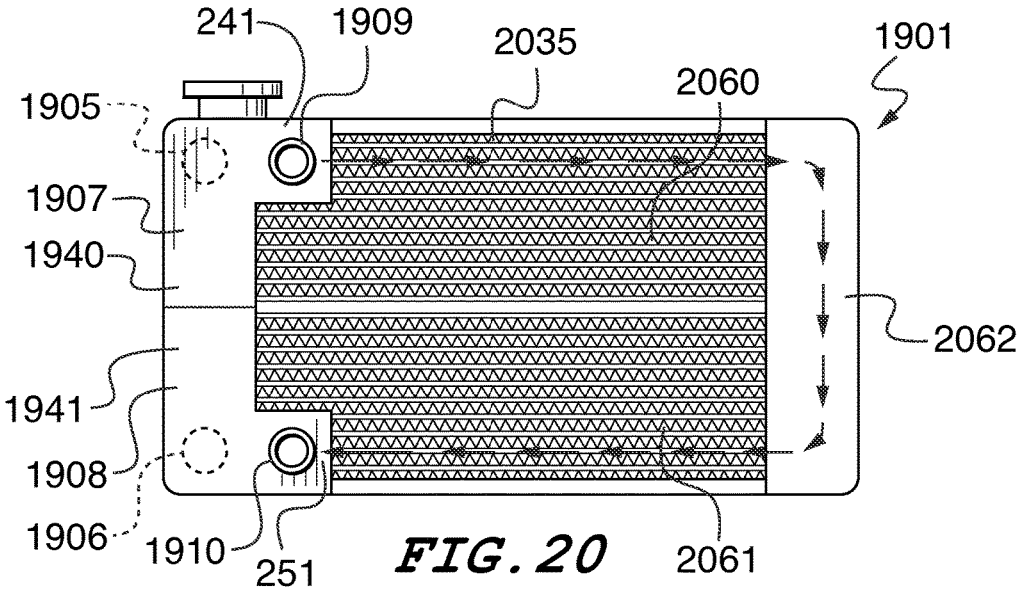
FIG. 20

COOLING SYSTEM AND A METHOD FOR ITS USE

CROSS-REFERENCE TO RELATED APPLICATIONS

This application claims benefit to provisional application No. 61/754,198, filed Jan. 18, 2013, which is incorporated by reference herein in its entirety.

FIELD OF THE INVENTION

The present cooling system relates to those used to cool internal combustion engines, which power most motor vehicles, but can also be used to cool any similarly functioning engine, or can be used in any industrial process machinery for cooling liquids for varied processes.

BACKGROUND

Radiators are required in nearly all motor vehicles to provide cooling for the vehicle's engine. Specifically, a coolant liquid is typically circulated between the engine and a radiator to dissipate heat created by the engine. However, the radiators found on some vehicles are not capable of sufficiently cooling the engine under certain use requirements and environmental conditions. This is particularly true of vehicles which have been modified to produce greater horsepower (i.e. large displacement, supercharging, turbocharging), engines that are operated at high rpm's for extended periods of time, and engines operated in warm environments.

Once integrated into a vehicle's design, radiator dimensions often become fixed and are typically not easily modifiable. The length and width of the radiator is often determined by the vehicle's body and the size of the radiator mounting area originally designed for a particular vehicle. Furthermore, the depth of the radiator, which could also be increased in order to obtain additional cooling capacity, can be limited by the space available between the core face, the cooling fan, and other engine ancillaries. Moreover, the radiator core supports and cross members found on most vehicles can provide additional obstacles for increasing the core depth, as the radiator tanks usually run along and between such supports. Also, the shapes and designs of the front ends of vehicles are also limited by the requirement that sufficient airflow across the radiator is needed and the radiator must be sufficiently large to provide proper cooling. These requirements can stifle creativity in the design of vehicles, particularly the designs of the front ends of vehicles.

The cooling capacity provided by a vehicle's radiator can be difficult or impossible to improve by lengthening, widening, or increasing the depth of the radiator. What is needed is a cooling system that can be adapted to work within the usable space that exists within the vehicle's body to provide additional cooling capacity.

SUMMARY OF THE INVENTION

It is an aspect of the present cooling system to provide a cooling system comprising at least one supplemental radiator that can be used in connection with a vehicle's existing radiator, or a similarly sized radiator mounted in its place, to provide additional cooling for an engine.

The above aspect can be obtained by a cooling system, comprising: a primary radiator comprising an upper stepped tank, the upper stepped tank comprising an engine-side inlet and a front-side outlet, and a lower stepped tank comprising a front-side inlet and an engine-side outlet, and a radiator core connected to the upper stepped tank and the lower stepped tank; a supplemental radiator comprising an upper tank, the upper tank comprising an upper tank inlet, a lower tank, the lower tank comprising a lower tank outlet, and a supplemental core connected to the upper tank and the lower tank; a first hose connecting the front-side outlet of the primary radiator to the upper tank inlet; and a second hose connecting the front-side inlet of the primary radiator to the lower tank outlet.

The above aspect can also be obtained by a cooling system, comprising: a primary radiator comprising a stepped cross-flow outlet tank and a stepped cross-flow inlet tank, the stepped cross-flow inlet tank comprising an engine-side inlet and a front-side outlet, and the stepped cross-flow outlet tank comprising a front-side inlet and an engine-side outlet, and a cross-flow radiator core connected to the stepped cross-flow outlet tank and the stepped cross-flow inlet tank; a supplemental radiator comprising a cross-flow outlet tank comprising an outlet tank outlet and a cross-flow inlet tank comprising an inlet tank inlet and a supplemental core connected to the cross-flow outlet tank and the cross-flow inlet tank; a first hose connecting the front-side outlet of the primary radiator to the upper inlet tank inlet of the supplemental radiator; and a second hose connecting the front-side inlet of the primary radiator to the outlet tank outlet of the supplemental radiator.

The above aspect can also be obtained by a method, the method comprising: providing a cooling system, comprising: a primary radiator comprising an upper stepped tank, the upper stepped tank comprising an engine-side inlet and a front-side outlet, and a lower stepped tank comprising a front-side inlet and an engine-side outlet, and a radiator core connected to the upper stepped tank and the lower stepped tank; a supplemental radiator comprising an upper supplemental tank, the upper tank comprising an upper supplemental tank inlet, a lower supplemental tank, the lower supplemental tank comprising a lower supplemental tank outlet, and a supplemental core connected to the upper supplemental tank and the lower supplemental tank; a first hose connecting the front-side outlet of the primary radiator to the upper supplemental tank inlet; and a second hose connecting the front-side inlet of the primary radiator to the lower supplemental tank outlet; providing an engine comprising a coolant inlet and a coolant outlet configured to be cooled by a coolant; and providing coolant; connecting the coolant outlet of the engine to the engine-side inlet of the primary radiator and connecting the engine-side outlet to the coolant inlet of the engine; circulating coolant from the engine, through the coolant outlet of the engine, into the upper tank of the primary radiator, through the engine-side inlet of the primary radiator, from the upper tank of the primary radiator through the front-side outlet of the primary radiator into the upper supplemental tank of the supplemental radiator, through the supplemental core to the lower supplemental tank, through the lower supplemental tank outlet and into the front-side inlet of the lower stepped tank of the primary radiator and from the lower stepped tank of the primary radiator into the coolant inlet of the engine through engine-side outlet of the lower stepped tank of the primary radiator.

BRIEF DESCRIPTION OF THE DRAWINGS

Further features and advantages of the present cooling system, as well as the structure and operation of various embodiments of the present cooling system, will become apparent and more readily appreciated from the following descriptions of the preferred embodiments, taken in conjunction with the accompanying drawings of which:

FIG. 19 is an engine side view of a secondary radiator having a double pass cross-flow configuration according to an embodiment;

FIG. 20 is a front side view of a primary radiator having a double pass cross-flow configuration according to an embodiment.

DETAILED DESCRIPTION

Figure 1:
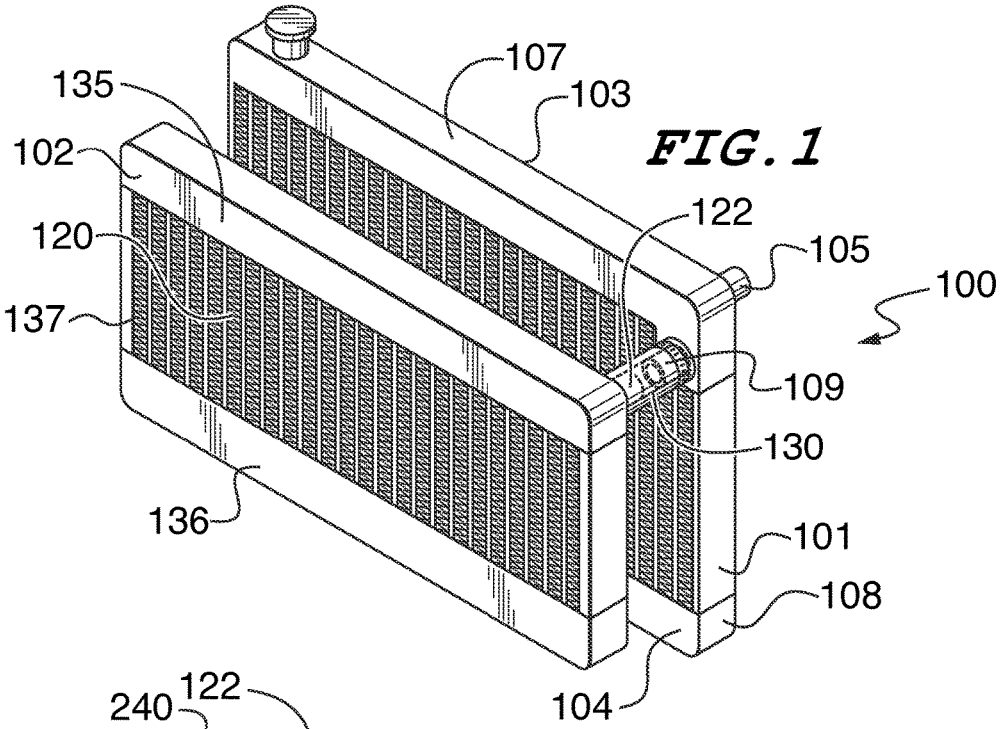
FIG. 1 is a perspective view of the front side of a cooling system comprising a primary radiator and a supplemental radiator, each radiator having a down-flow configuration according to an embodiment.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the present embodiments of the invention, examples of which are illustrated in the accompanying drawings, wherein like reference numerals refer to like elements throughout.

The present cooling system can add cooling capacity to a vehicle without the need to alter the original structure of the body or frame of that vehicle, thus allowing its original design features to remain intact. In an embodiment, the present cooling system could comprise a "primary radiator" which could occupy the same location as a vehicle's original radiator. This primary radiator could be connected to one or more "supplemental radiators" which could be located in places within the vehicle where sufficient space exists, such as between the grille of a vehicle and the primary radiator. The existing vehicle radiator could be modified to act as the primary radiator in the present cooling system. However, the present cooling system may more often require a new primary radiator installed, having the same dimensions as the original primary radiator, but having been modified to allow for the connection of one or more supplemental radiators. In the discussion below, both new radiators, initially configured to connect to one or more supplemental radiators, and stock radiators, modified to achieve this same purpose, will be referred to hereinafter as "primary radiators."

In an embodiment, the primary radiator can comprise one or more stepped tanks. Typical radiator tanks are not stepped and are designed to contain a similar volume of liquid in any given cross section of each tank. However, a stepped tank can allow a greater volume of coolant to be contained within cross sections of the stepped parts of each tank, than can be contained within the non-stepped parts of each tank. According to an embodiment, the stepped tanks comprising a primary tank can be configured to allow coolant to flow to the side opposite that of the radiator's original coolant inlet and outlet connections, which are typically located on the side closest to the engine. In other words, coolant can flow into the primary radiator through the engine side inlet, then flow through a stepped tank and out of the primary radiator through an outlet located on the opposite side of the stepped tank. One or more hoses, tubes or similar suitable structures or devices can be used to connect the primary radiator to one or more supplemental radiators, allowing coolant to flow from the primary radiator to one or more supplemental radiators. Any suitable shape of pipe, hose or tube can be used to connect the primary radiator to one or more supplemental radiators. However, flexible hoses and similar flexible devices may facilitate the installation of a supplemental radiator within the vehicle's body without the need to modify the existing vehicle's body structure.

The use of stepped tanks and the parallel connections facilitated by them can allow for multiple configurations of primary and supplemental radiators. For example, in an embodiment, two or more smaller supplemental radiators, which connect directly to a primary radiator, could be used to fit within the size constraints of a particular vehicle body, or a single supplemental radiator that is half as long or half as wide as the primary radiator could be connected to the primary radiator to avoid some particular structural constraints of a vehicle's body or frame. Additionally, the present cooling system can comprise manual or automatic valves that can control the amount of coolant flow to the supplemental radiator(s) from the primary radiator, allowing the user to adjust the amount of cooling performed by the supplemental radiator(s).

Figure 2:
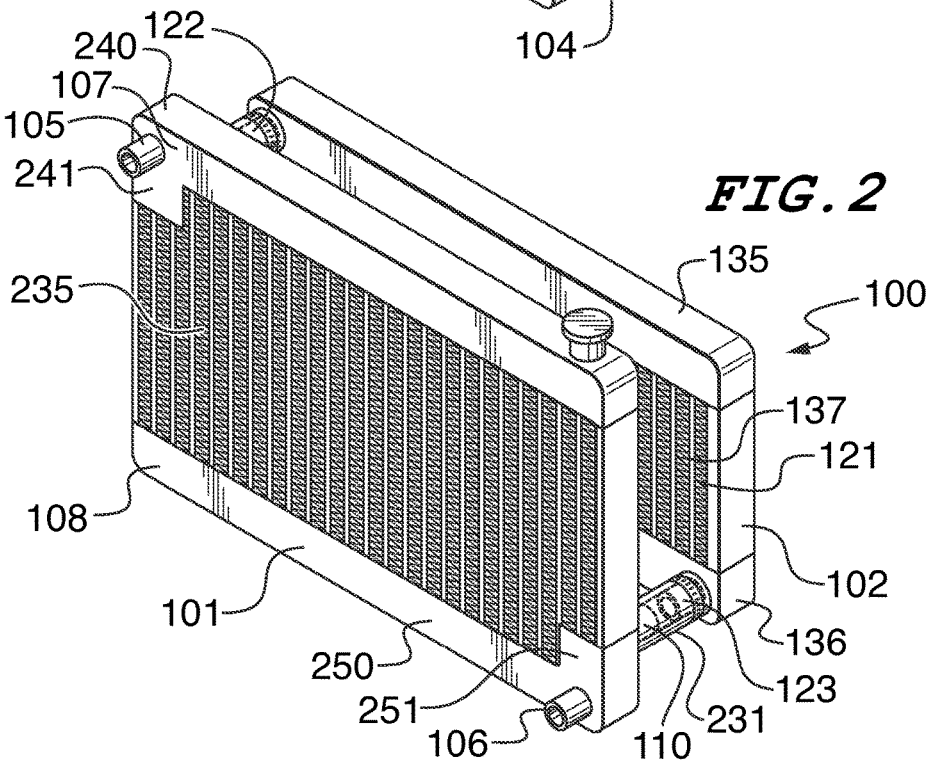
FIG. 2 is a perspective view of the engine-side of a cooling system shown in FIG. 1 comprising a primary radiator and a supplemental radiator, each radiator having a down-flow configuration according to an embodiment.

FIG. 1 is a perspective view of the front side and FIG. 2 is a perspective view of the engine-side of a cooling system 100 comprising a primary radiator 101 and a supplemental radiator 102, each radiator having a down-flow configuration according to an embodiment. A cooling system 100 can comprise a primary radiator 101 and a supplemental radiator 102. Such radiators can be made, either entirely or in part, from copper, aluminum or any other suitable material known in the art of radiator manufacturing.

The primary radiator 101 can comprise an engine side 103 and a front side 104. The engine side 103 of the primary radiator 101 can comprise an engine-side inlet 105 through which hot coolant (not shown) from the engine (not shown in FIGS. 1 and 2) can enter the primary radiator 101. The engine side 103 of the primary radiator 101 can also comprise an engine-side outlet 106, through which cooled coolant (not shown) can return to the engine from the cooling system 100.

In an embodiment, the engine-side inlet 105 can be connected to an inlet radiator tank 107. This inlet radiator tank 107 can be stepped on at least one side forming an inlet stepped section 241. In an embodiment, the engine-side inlet 105 can be connected to the inlet stepped section 241 of the inlet radiator tank 107. Similarly, the engine-side outlet 106 can be connected to an outlet radiator tank 108. As with the inlet radiator tank 107, the outlet radiator tank 108 can be stepped on at least one side forming an outlet stepped section 251. In an embodiment, the engine-side outlet 106 can be connected to the outlet stepped section 251 of the outlet radiator tank 108.

In an embodiment, the front side 104 of the primary radiator 101 can comprise front-side outlet 109 connected to the inlet stepped section 241 of the inlet radiator tank 107 opposite the engine-side inlet 105. Likewise, the front side 104 of the primary radiator 101 can comprise a front-side inlet 110 connected to the outlet stepped section 251 of the outlet radiator tank 108 opposite the engine-side outlet 106. The supplemental radiator 102 can comprise a front side 120 and a backside 121. In an embodiment, the front side 120 can face the front of the vehicle and the backside 121 and can face the primary radiator 101, as well as the vehicle's engine compartment, however, the present cooling system 100 is not limited to this configuration. In an embodiment, the front side 120 of the supplemental radiator 102 can comprise no inlets or outlets, as shown in FIGS. 1 and 2. However, in alternative embodiments, the front side 120 of the supplemental radiator 102 can comprise additional inlets and outlets configured to connect to additional supplemental radiators (see FIG. 14 for an example).

The backside 121 of the supplemental radiator 102 can comprise the backside inlet 122 and the backside outlet 123. In an embodiment, the supplemental radiator 102 can comprise an inlet tank 135, an outlet tank 136 and a core 137. The backside inlet 122 can be located near the top of the supplemental radiator 102 and can be connected to the inlet tank 135. Similarly, the backside outlet 123 can be located near the bottom of the supplemental radiator 102 and can be connected to the outlet tank 136. In this embodiment, coolant can flow from the primary radiator 101 to the supplemental radiator 102 through the backside inlet 122. Once the coolant has entered into the inlet tank 135 of the supplemental radiator 102 it can pass through the radiator core 137, from top to bottom in a down-flow configuration, and into the outlet tank 136 where it can return to the primary radiator 101 through the backside outlet 123.

According to an embodiment, the front side outlet 109 of the primary radiator 101 can be connected to the backside inlet 122 of the supplemental radiator 102 by a first piece of tubing 130. Similarly, the backside outlet 123 of the supplemental radiator 102 can be connected to the front side inlet 110 of the primary radiator 101 by a second piece of tubing 231.

According to an embodiment, coolant can flow from the engine through the engine-side inlet 105 into the primary radiator 101. The coolant can enter the inlet radiator tank 107. From the inlet radiator tank 107 the coolant can either flow into the front-side outlet 109 and into the supplemental backside inlet 122 comprising the supplemental radiator 102, or through the radiator core 235. The coolant that entered into the supplemental radiator 102 can fill the inlet tank 135 wherein in the embodiment shown in FIGS. 1 and 2 the coolant can pass through the radiator core 137 and enter the outlet tank 136. From the outlet tank the cooled coolant can pass through the backside outlet 123 and enter the primary radiator 101 through the front side inlet 110.

Once the coolant returns to the primary radiator 101 from the supplemental radiator 102, the coolant can combine with the coolant that passed through the radiator core 235 in the outlet radiator tank 108. This combined cooled coolant can then flow back to the engine through the engine-side outlet 106.

Figure 3:
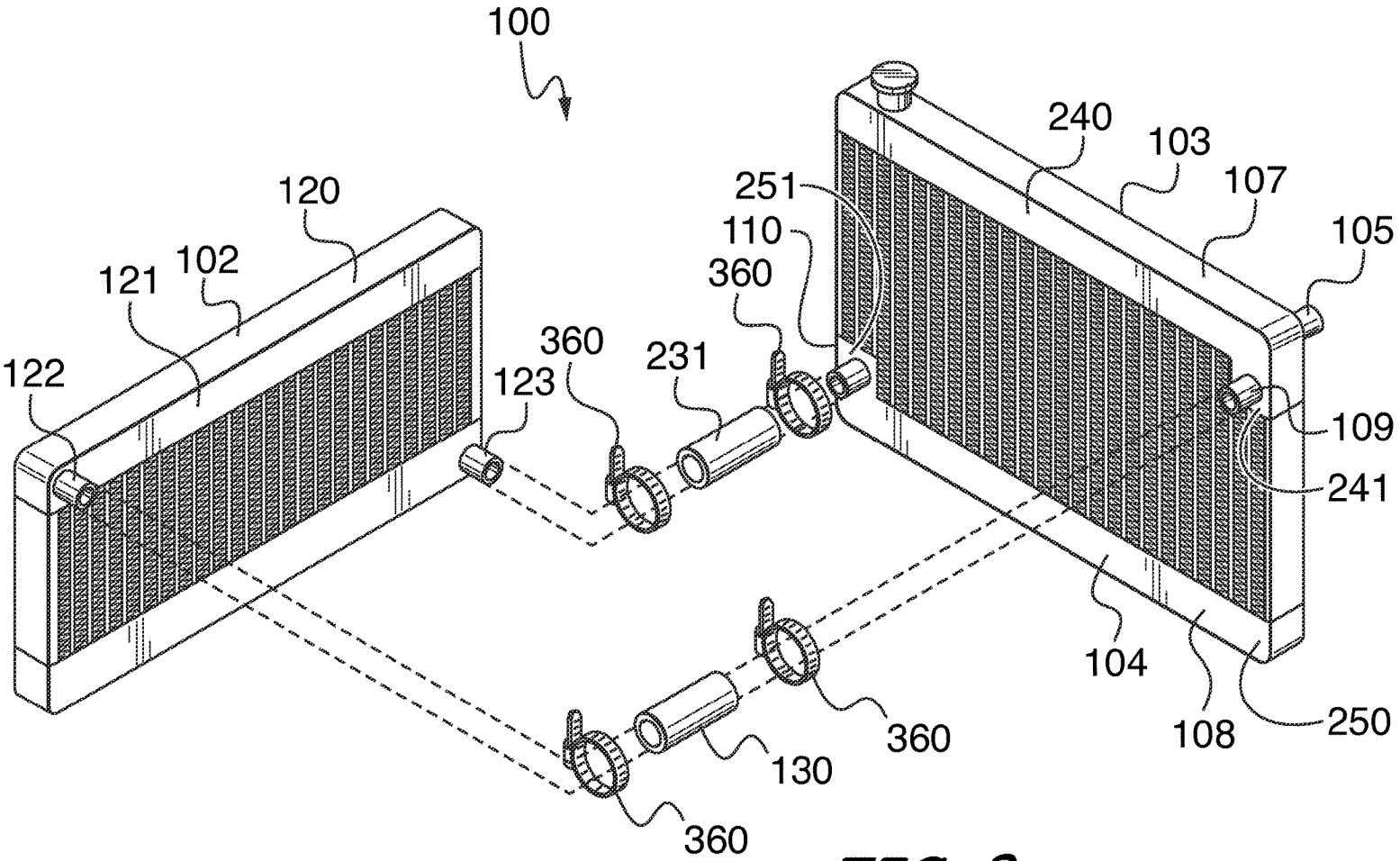
FIG. 3 is an exploded view of the cooling system shown in FIGS. 1 and 2 comprising a primary radiator and a supplemental radiator, each radiator having a down-flow configuration according to an embodiment.

FIG. 3 is an exploded view of the cooling system 100 shown in FIGS. 1 and 2 comprising a primary radiator 101 and a supplemental radiator 102, each radiator having a down-flow configuration according to an embodiment. This view clearly shows the points of connection between the primary radiator 101 and the supplemental radiator 102 according to an embodiment.

In this embodiment, the front side outlet 109 of the primary radiator 101 can be in alignment with the backside inlet 122 of the supplemental radiator 102 allowing each to be connected to the other by a short, straight hose 130 and 231, or similar structure, wherein the hose 130 and 231 can be connected by two or more hose clamps 360. However, in alternative embodiments, the present cooling system 100 can also comprise configurations wherein the primary radiator 101 and any supplemental radiator(s) 102 can be totally unaligned and require curved or angled tubing of any length in order to make the connections between the radiators. The first and second pieces of tubing, 130 and 231, can be either rigid or flexible. In some embodiments, the use of flexible tubing for the connection between the primary radiator 101 and the secondary radiator 102 may facilitate the connection of a supplemental radiator 102 that is in a location which is not close to the primary radiator 101.

Similarly, although the front side outlet 109 is shown at one side of the inlet radiator tank 107, it can be located at any location where an inlet stepped section 241 may also be located. Likewise, although the front side inlet 110 can be located at any location along the outlet radiator tank 108, in can be located at any location where an outlet stepped section 251 may also be located.

Figure 4:
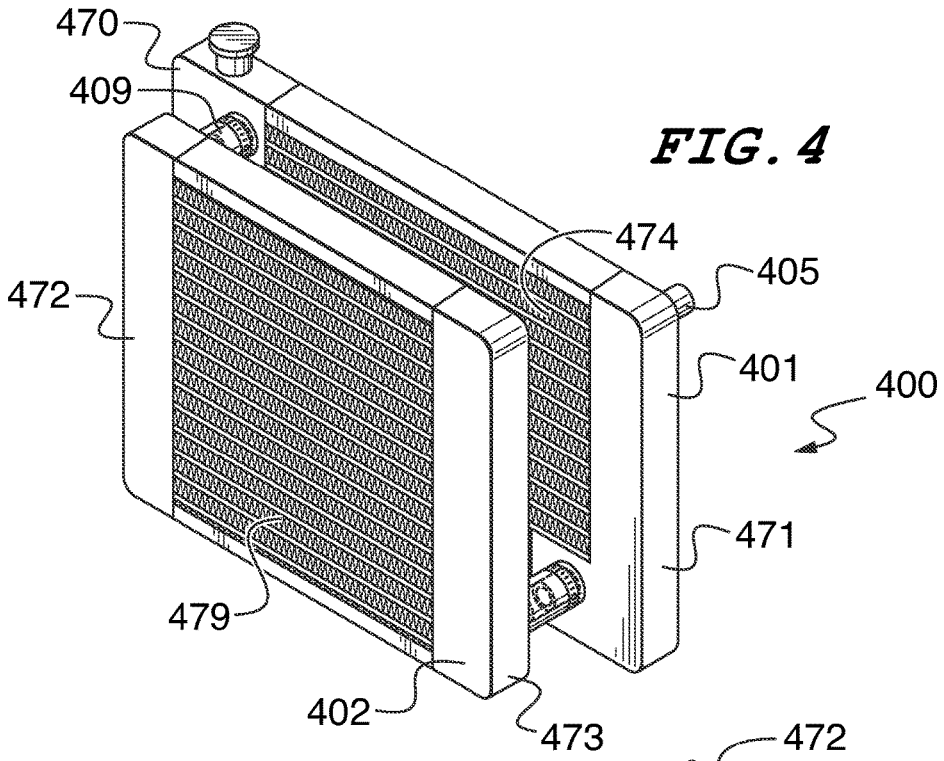
FIG. 4 is a perspective view of the front side of a cooling system comprising a primary radiator and a supplemental radiator, each radiator having a cross-flow configuration according to an embodiment.
Figure 5:
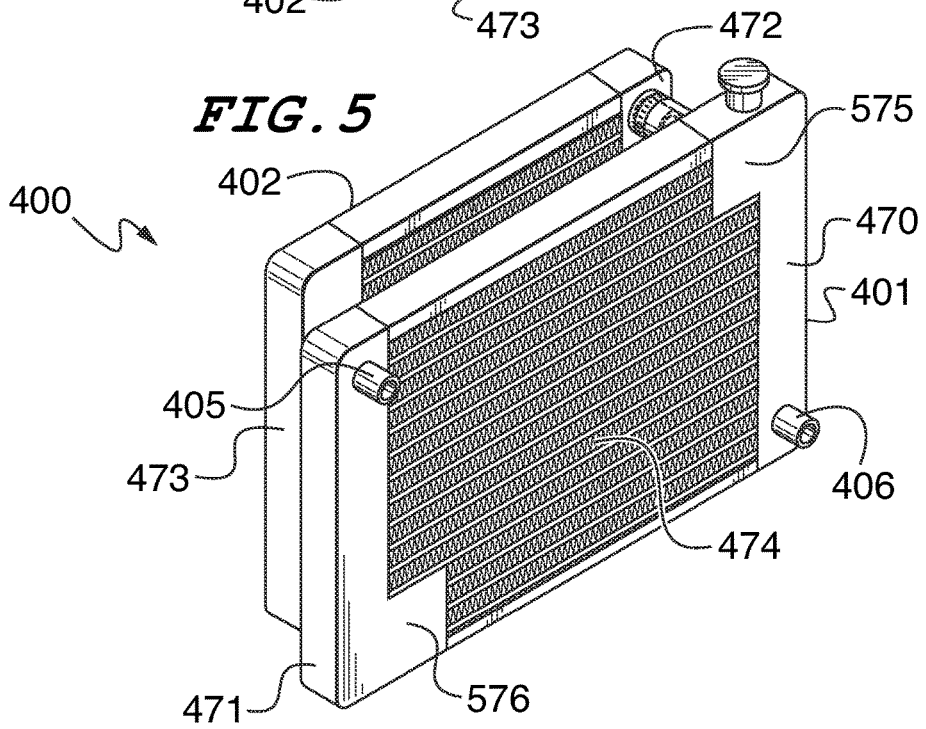
FIG. 5 is a perspective view of the engine-side of a cooling system, shown in FIG. 4, comprising a primary radiator and a supplemental radiator, each radiator having a cross-flow configuration according to an embodiment.

FIG. 4 is a perspective view of the front and FIG. 5 is a perspective view of the engine-side of a cooling system 400 comprising a primary radiator 401 and a supplemental radiator 402, each radiator having a cross-flow configuration according to an alternative embodiment. In an alternative embodiment, the cooling system 400 can also be comprised of one or more cross-flow type radiators. In a cross-flow configuration, the primary radiator 401 can comprise a cross-flow outlet tank 470 and a cross-flow inlet tank 471, wherein each can be located on opposite sides of a cross-flow radiator core 474, according to an embodiment.

One or more supplemental radiators can have a similar configuration. In FIG. 4, a supplemental radiator 402 can comprise a cross-flow outlet tank 472 and a cross-flow inlet tank 473, wherein each can be located on opposite sides of a cross-flow radiator core 479. In an embodiment, the cross-flow outlet tank 470 can be stepped, and this stepped part of the cross-flow outlet tank 470 can be referred to as a stepped outlet section 575. The stepped outlet section 575 can be located at any height along the cross-flow outlet tank 470. In the embodiment shown in FIGS. 4-6, the stepped outlet section 575, is located at the top of the cross-flow outlet tank 470 comprising the primary radiator 101. In an embodiment, this stepped outlet section 575 can extend into the area that would otherwise be occupied by the cross-flow core 474 comprising the primary radiator 401.

Figure 6:
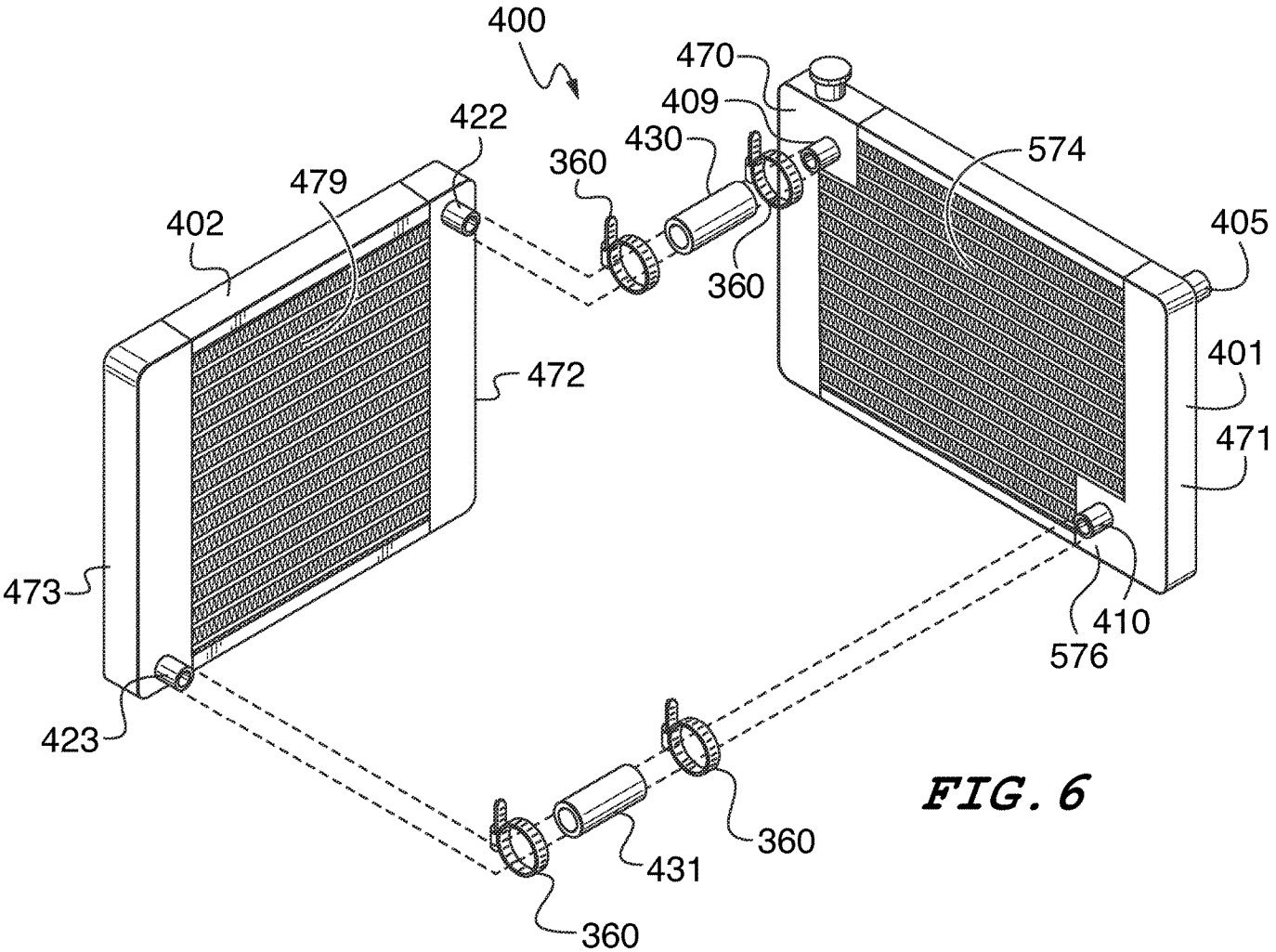
FIG. 6 is an exploded view of the cooling system shown in FIGS. 4 and 5, comprising a primary radiator and a supplemental radiator, each radiator having a cross-flow configuration according to an embodiment.

FIG. 6 is an exploded view of the cooling system shown in FIGS. 4 and 5, comprising a primary radiator and a supplemental radiator, each radiator having a cross-flow configuration according to an embodiment. In this view, the parts comprising both the primary radiator 401, the secondary radiator 402, and the connections between them are shown clearly. Specifically, the supplemental radiator 402 is shown to comprise a cross-flow outlet tank 472, a cross-flow inlet tank 473, and a cross-flow radiator core 479. In an embodiment, a backside outlet 422 can be connected to the cross-flow outlet tank 472 and a backside inlet 423 can be connected to the cross-flow inlet tank 473. The backside outlet 422 and backside inlet 423 can be connected at any position along their respective tanks so long as their connection to the primary radiator 401 can be achieved. In the embodiment shown in FIGS. 4-6, the backside outlet 422 is located at the top of the cross-flow outlet tank 472 and the backside inlet 423 is located at the bottom of the cross-flow inlet tank 473.

According to an embodiment, the cooling system 400, having a cross-flow configuration, can comprise a primary radiator 401 and supplemental radiator 402 connected to each other in an arrangement similar to the cooling system 100 having a down-flow configuration described above. Specifically, the primary radiator 401 and supplemental radiator 402 can be connected by attaching the front side inlet 409 to the backside outlet 422 using a first tube 430 and the backside inlet 423 to the front side outlet 410 by a second tube 431 according to an embodiment. The first tube 430 and the second tube 431 can be connected to their respective inlets and outlets by hose clamps 360 or any other suitable fastening device.

In an embodiment, a hot coolant can flow from the engine (not shown) into the cooling system 400 having a cross-flow configuration through the engine side inlet 405 into the cross-flow inlet tank 471. Once in the cross-flow inlet tank 471, coolant can then travel either through the cross-flow core 474 and be cooled according to the common cross-flow radiator process using only a primary radiator 401, or the coolant can travel to the supplemental radiator 402 through the front side outlet 410, which can be connected to a stepped inlet section 576.

Coolant returning from the supplemental radiator 402 to the primary radiator 401 can do so by passing through the backside outlet 422 into the front side inlet 409. Prior to returning to the engine, the cooled coolant can collect in the cross-flow outlet tank 470. Coolant traveling across the primary cross-flow core 574 can also enter into the cross-flow outlet tank 470. The coolant can then exit the cooling system 400 and return to the engine (not pictured) through the engine side outlet 406.

Figure 7:
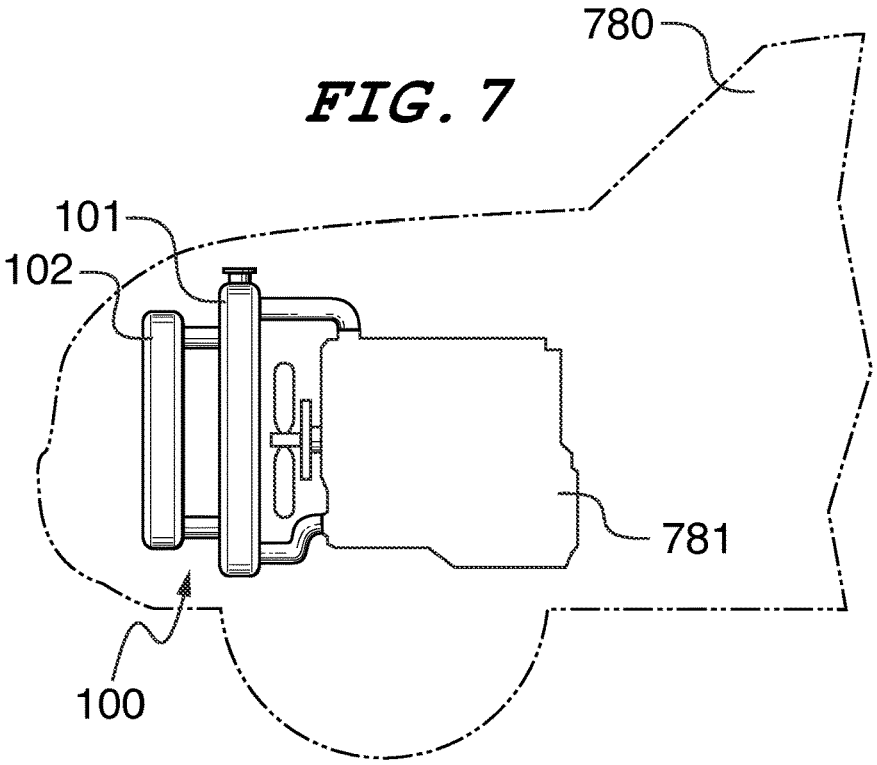
FIG. 7 is a side view of a cooling system comprising a primary radiator and a supplemental radiator connected to an engine within a car according to an embodiment.

FIG. 7 is a side view of a cooling system 100 comprising a primary radiator 101 and a supplemental radiator 102 connected to an engine 781 within a vehicle 780 according to an embodiment. In the embodiment shown in FIG. 7, the cooling system 100 can be located adjacent to the engine 781 of the vehicle 780. Specifically, the primary radiator 101 can be located where a stock radiator is commonly found in vehicles, namely directly in front of the engine 781. The supplemental radiator 102, can be located anywhere there is room for it and can be configured to fit into small compartments within the vehicle 780. In the simplest embodiment of the present cooling system 100, the supplemental radiator 102 can be located directly in front (opposite of the engine 781) of the primary radiator 101.

Figure 8:
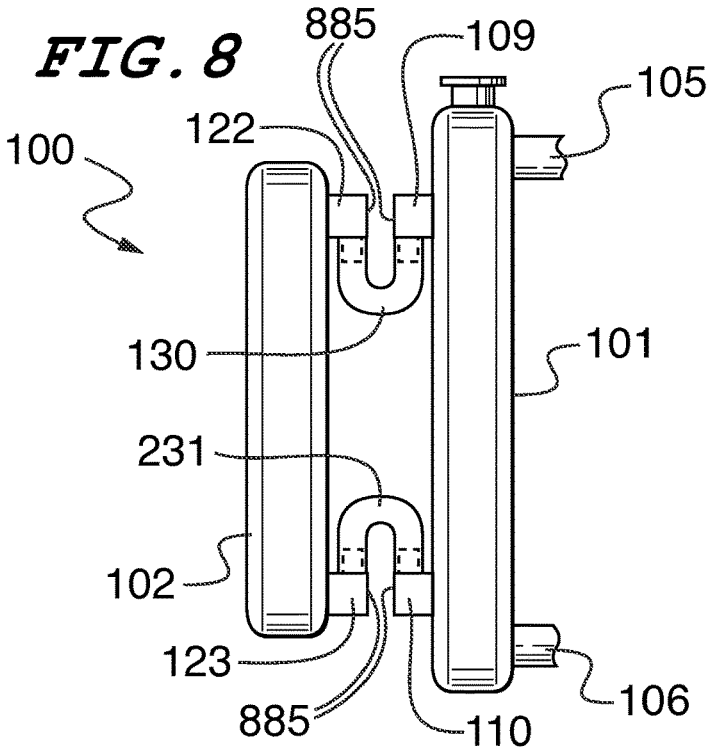
FIG. 8 is a side view of a cooling system comprising a primary radiator and a supplemental radiator, each radiator connected to the other by an alternate style of ports and hoses according to an alternative embodiment.

FIG. 8 is a side view of a cooling system 100 comprising a primary radiator 101 and a supplemental radiator 102, each radiator connected to the other by an alternate style of inlets and outlets 109, 110, 122 and 123 according to an alternative embodiment. The inlets and outlets 109, 110, 122 and 123 can be any size or shape which allows coolant to flow freely from the primary radiator 101 to the supplemental radiator 102 and back. The alternative design shown in FIG. 8 can comprise inlets 110 and 122 and outlets 109 and 123 that comprise a 90 degree angle 885, according to an embodiment. This 90 degree angle 885 can allow the first and second pieces of tubing 130 and 231 to be attached parallel to one or more of the radiators comprising the cooling system 100 rather than perpendicular to them. This design may save space and allow the primary radiator 101 and the supplemental radiator 102 to be located in places within the engine compartment that would not allow for the first and second pieces of tubing 130 and 231 to extend directly out from the radiators 101 and 102. Angles other than a 90 degree angle 885 are also contemplated as being part of the present cooling system 100.

Figure 9:
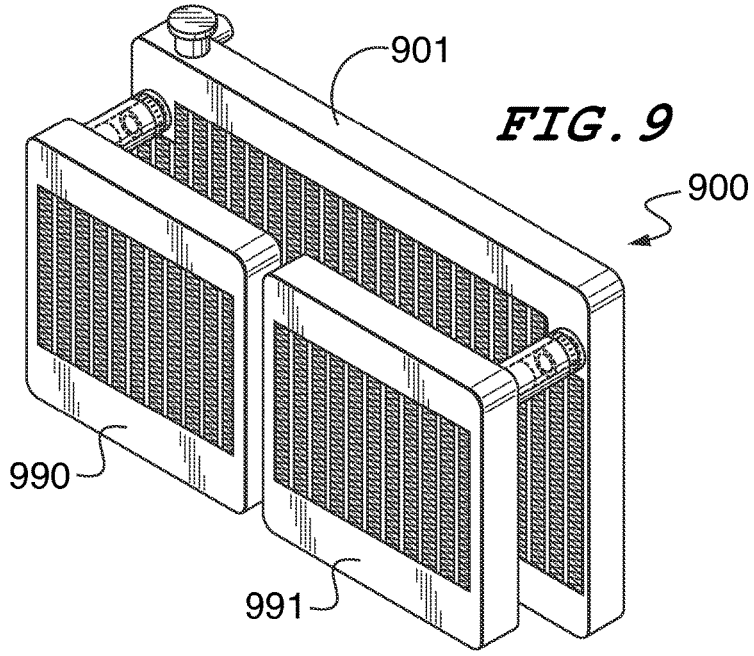
FIG. 9 is a perspective view of the front side of a cooling system comprising a primary radiator and two supplemental radiators, each radiator having a down-flow configuration according to an embodiment.

FIG. 9 is a perspective view of the front of a cooling system 900 comprising a primary radiator 901 and two supplemental radiators, 990 and 991, each radiator having a down-flow configuration according to an embodiment. The cooling system 900 is one of numerous designs that can be configured to comprise a primary radiator 901 configured to connect to one or more supplemental radiators, 990 and 991 in FIG. 9. Specifically, the embodiment shown in FIG. 9 comprises a primary radiator 901 connected to both a first supplemental radiator 990 and a second supplemental radiator 991. The number of supplemental radiators 102 is only limited by the space available.

Figure 10:
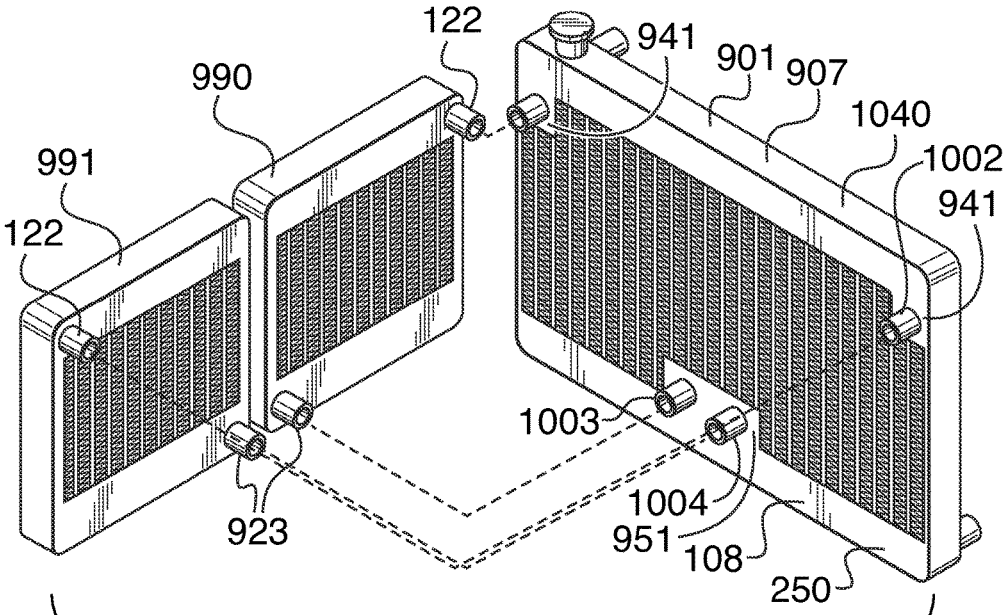
FIG. 10 is an exploded view of the cooling system shown in FIG. 9 comprising a primary radiator and two supplemental radiators, each radiator having a down-flow configuration according to an embodiment.

FIG. 10 is an exploded view of the cooling system 900 shown in FIG. 9 comprising a primary radiator 901 and two supplemental radiators, 990 and 991, each radiator having a down-flow configuration according to an embodiment. When two supplemental radiators, 990 and 991, are attached in parallel to the primary radiator 901, as in this embodiment, the configuration is similar to that of the cooling system 100 wherein only a single supplemental radiator 102 is present. However, the inlet radiator tank 907 must comprise two inlet stepped sections 941 or one outlet stepped section 951 that is sufficiently large to allow for the connection of two front side inlets 1003 and 1004. In an embodiment, a first front side outlet 1001 can be connected to one inlet stepped section 941 and a second front side outlet 1002 can be connected to anther inlet stepped section 941. The first front side outlet 1001 can be connected to the first supplemental radiator 990 and the second front side outlet 1002 can be connected to the second supplemental radiator 991. More specifically, the first front side inlet 1003 can be connected to the outlet 923 of the first supplemental radiator 990 and the second primary front side inlet 1004 can be connected to the outlet 923 of the second supplemental radiator 991. According to an embodiment, each supplemental radiator, 990 and 991, can be configured the same as the supplemental radiator 102 described above.

Figure 11:
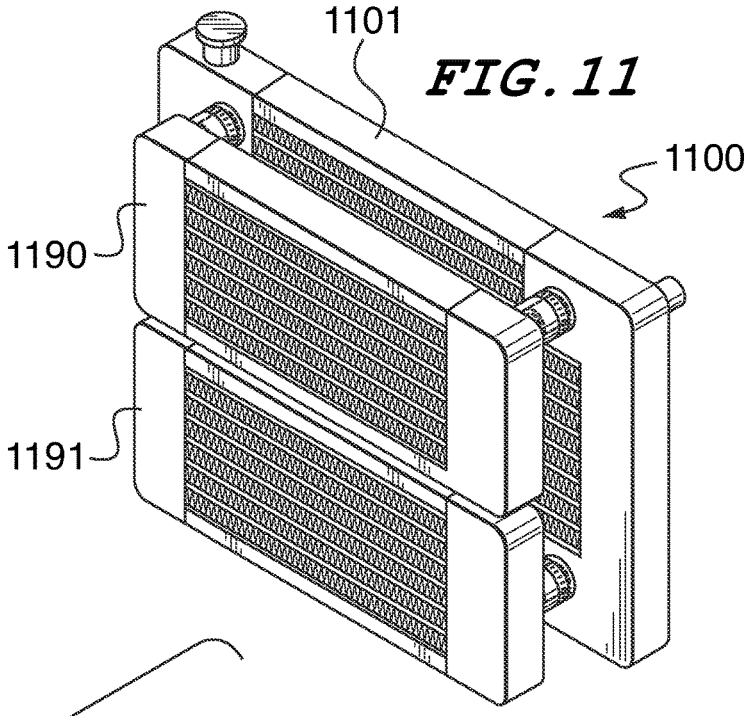
FIG. 11 is a perspective view of the front side of a cooling system comprising a primary radiator and two supplemental radiators, each radiator having a cross-flow configuration according to an embodiment.
Figure 12:
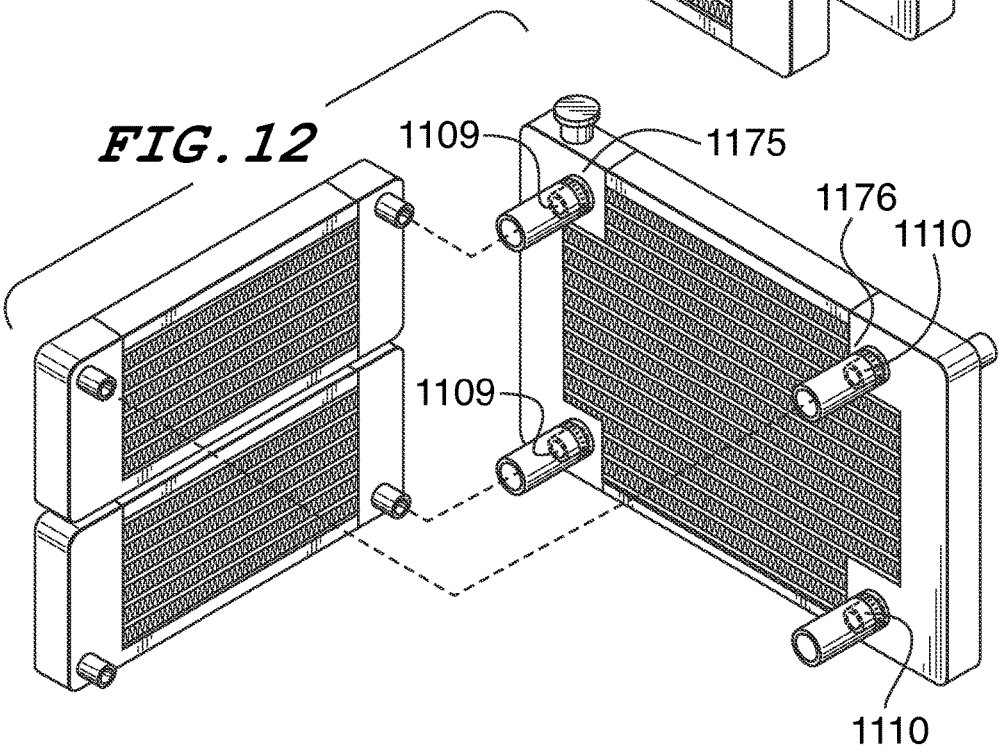
FIG. 12 is an exploded view of the cooling system shown in FIG. 11 comprising a primary radiator and two supplemental radiators, each radiator having a cross-flow configuration according to an embodiment.

FIG. 11 is a perspective view of the front and FIG. 12 is an exploded view of a cooling system 1100 comprising two supplemental radiators, 990 and 991, wherein all of the radiators have a cross-flow configuration, according to an embodiment. Similar to the cooling system 900 having a down-flow configuration, the cooling system 1100 can comprise one primary radiator 1101 and two supplemental radiators, 1190 and 1191, but wherein all radiators have a cross-flow configuration. The stepped inlet sections 1175 and stepped outlet sections 1176 of the tanks must be sized to accommodate two inlets 1110 and two outlets 1109.

Figure 13A:
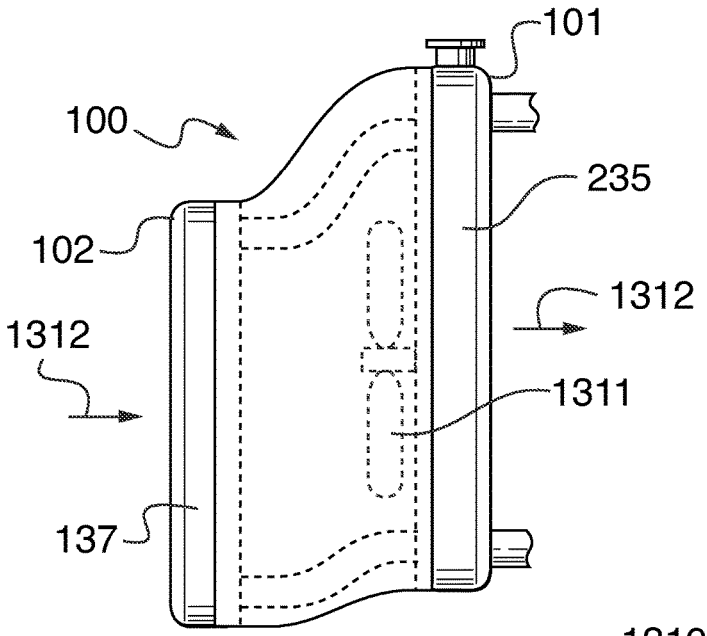
FIG. 13A is a side view of a cooling system comprising a primary radiator and a supplemental radiator, wherein the system comprises a shroud connecting the primary radiator and the supplemental radiator and a cooling fan located within the shroud according to an embodiment.

FIG. 13A is a side view of a cooling system 100 comprising a shroud 1310 and an internal fan 1311 according to an embodiment. In the embodiment shown in FIG. 13A, the internal fan 1311 can be located between the primary radiator 101 and the supplemental radiator 102. This shroud 1310 can direct airflow 1312 through the supplemental radiators 102 and then through the primary radiator 101 in order to facilitate cooling.

Figure 13B:
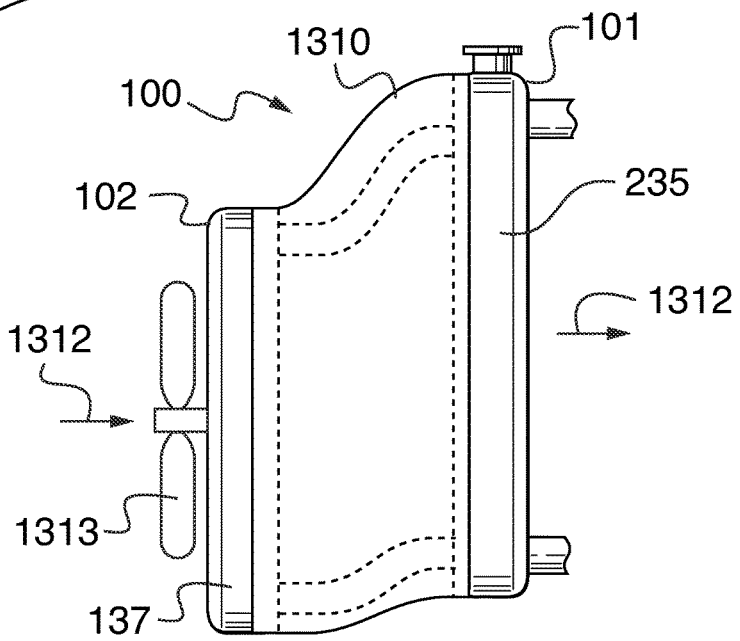
FIG. 13B is a side view of a cooling system comprising a primary radiator and a supplemental radiator, wherein the system comprises a shroud connecting the primary radiator and the supplemental radiator and a cooling fan located in front of the supplemental radiator according to an embodiment.

FIG. 13B is a side view of a cooling system 100 comprising a shroud 1310 and an external fan 1313 according to an embodiment. In this embodiment, the external fan 1313 pushes air 1312 over the core 137 of the supplemental radiator 102 and into the shroud 1310 wherein the air can then pass through the core 235 of the primary radiator 101, which could be facilitated by a fan located between the engine and primary radiator 101 in some embodiments.

Figure 14:
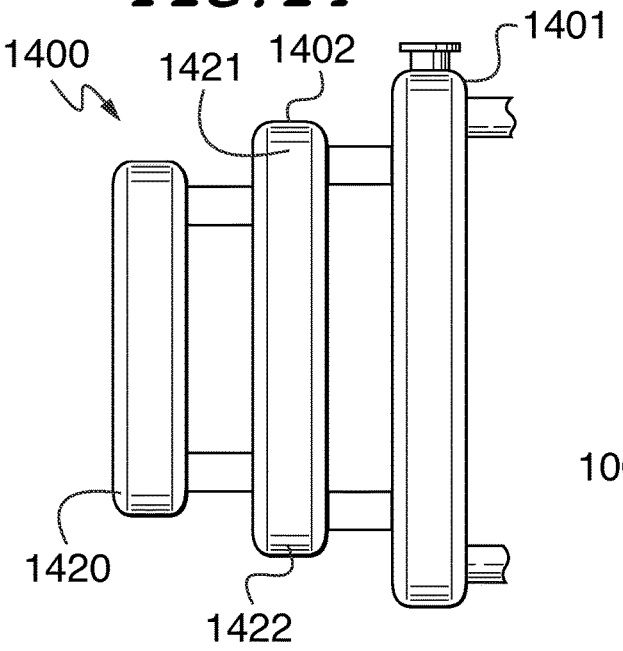
FIG. 14 is a side view of a cooling system comprising a primary radiator and two supplemental radiators, a secondary radiator and a tertiary radiator, all attached in parallel according to an embodiment.

FIG. 14 is a side view of a cooling system 1400 comprising a tertiary radiator 1420 attached to a secondary radiator 1402 attached to a primary radiator 1401 according to an embodiment. In an alternative embodiment a tertiary radiator 1420 can be connected in series with a secondary radiator 1402. In this configuration the secondary radiator 1402 comprises a stepped secondary inlet tank 1421 and a stepped secondary outlet tank 1422 and can comprise inlets and outlets matching the number and position of those comprising the primary radiator 1401.

Figure 15:
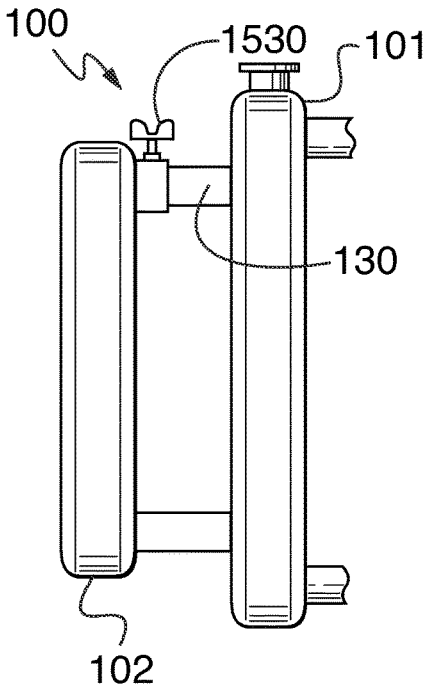
FIG. 15 is a side view of a cooling system comprising a primary radiator and a supplemental radiator, wherein the tubing connecting the primary radiator and the supplemental radiator comprises a manually controlled valve according to an embodiment.

FIG. 15 is a side view of a cooling system 100 comprising a primary radiator 101 and a supplemental radiator 102, wherein the tubing 130 connecting the primary radiator 101 and the supplemental radiator 102 comprises a manually controlled valve 1530 according to an embodiment. This manual valve 1530 can be used to restrict or prevent the flow of coolant from the primary radiator 101 to the supplemental radiator 102, allowing the cooling system 100 to perform like a standard, single radiator system when the manually controlled valve 1530 is closed.

Figure 16:
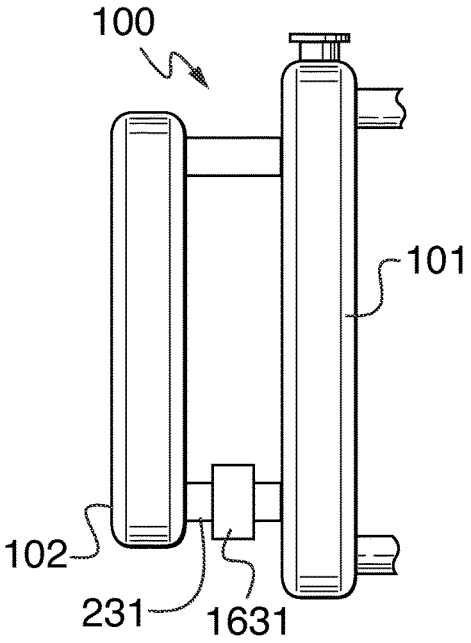
FIG. 16 is a side view of a cooling system comprising a primary radiator and a supplemental radiator, wherein the tubing connecting the primary radiator and the supplemental radiator comprises an automatically controlled valve according to an embodiment.

FIG. 16 is a side view of a cooling system 100 comprising a primary radiator 101 and a supplemental radiator 102, wherein the tubing 231 connecting the primary radiator 101 and the supplemental radiator 102 comprises an automatically controlled valve 1631 according to an embodiment. This automatically controlled valve 1631 can control the flow of coolant just as the manually controlled valve 1530 described above. However, the automatic valve 1631 can be configured to be controlled by changes in engine temperature, providing additional cooling when the engine begins to overheat. In a further alternative embodiment, the automatic valve 1631 can be configured to be controlled by other criteria such as ambient air temperature or altitude.

Figure 17:
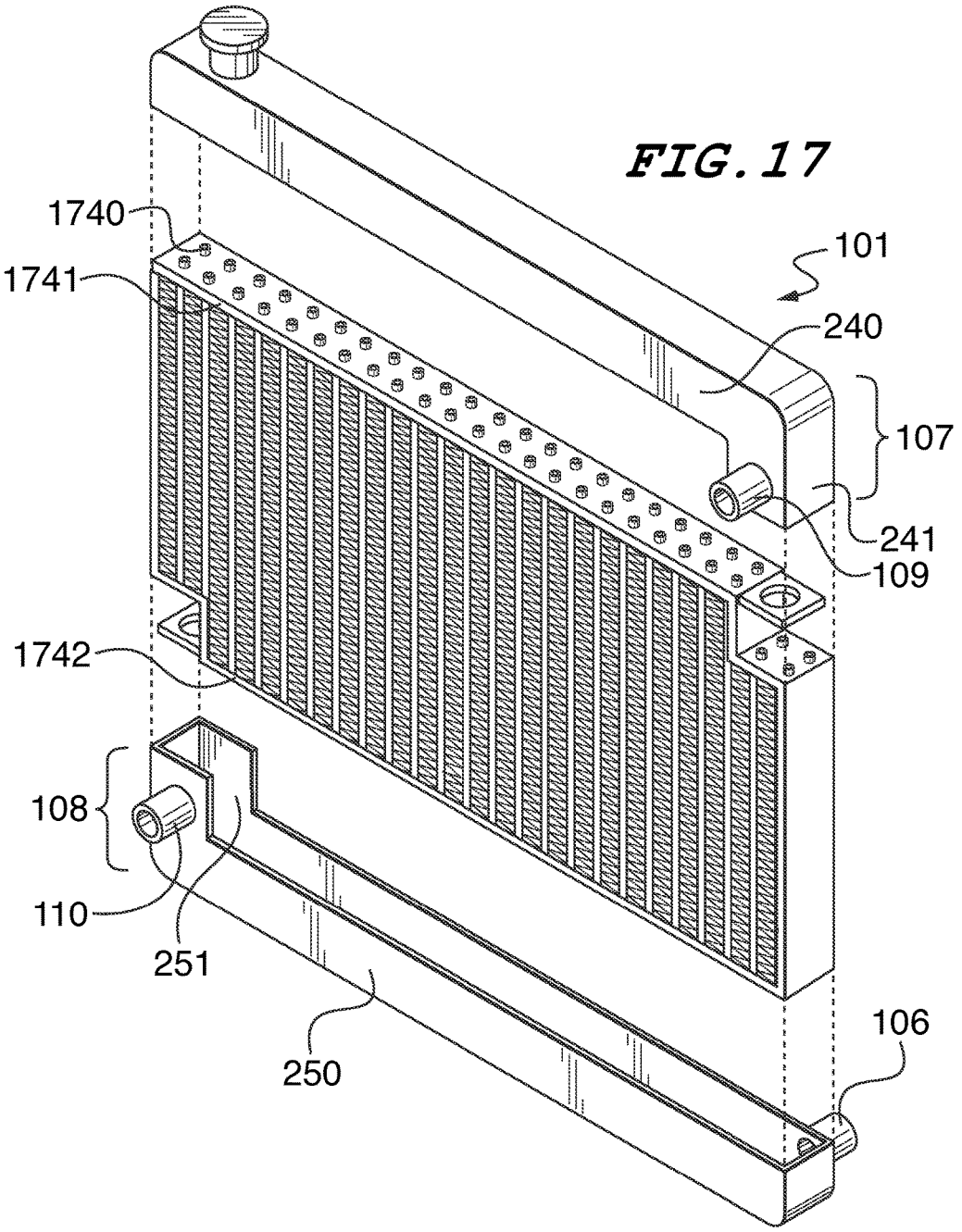
FIG. 17 is a perspective exploded front and side view of a primary radiator having a down-flow configuration according to an embodiment.

FIG. 17 is a perspective exploded front and side view of a primary radiator 102 having a down-flow configuration according to an embodiment. As discussed above, the radiator core 235 comprising the primary radiator 101 can comprise stepped radiator tanks 107 and 108. The radiator core 235 can comprise a standard configuration including numerous ports 1740 connecting the inlet radiator tank 107 and the outlet radiator tank 108. At the locations of the inlet stepped section 241 on the inlet stepped radiator tank 107 and the outlet stepped section 251 on the outlet stepped radiator tank 108 the core 235 can be cutout to make room for these stepped sections 241 and 251.

Figure 18:
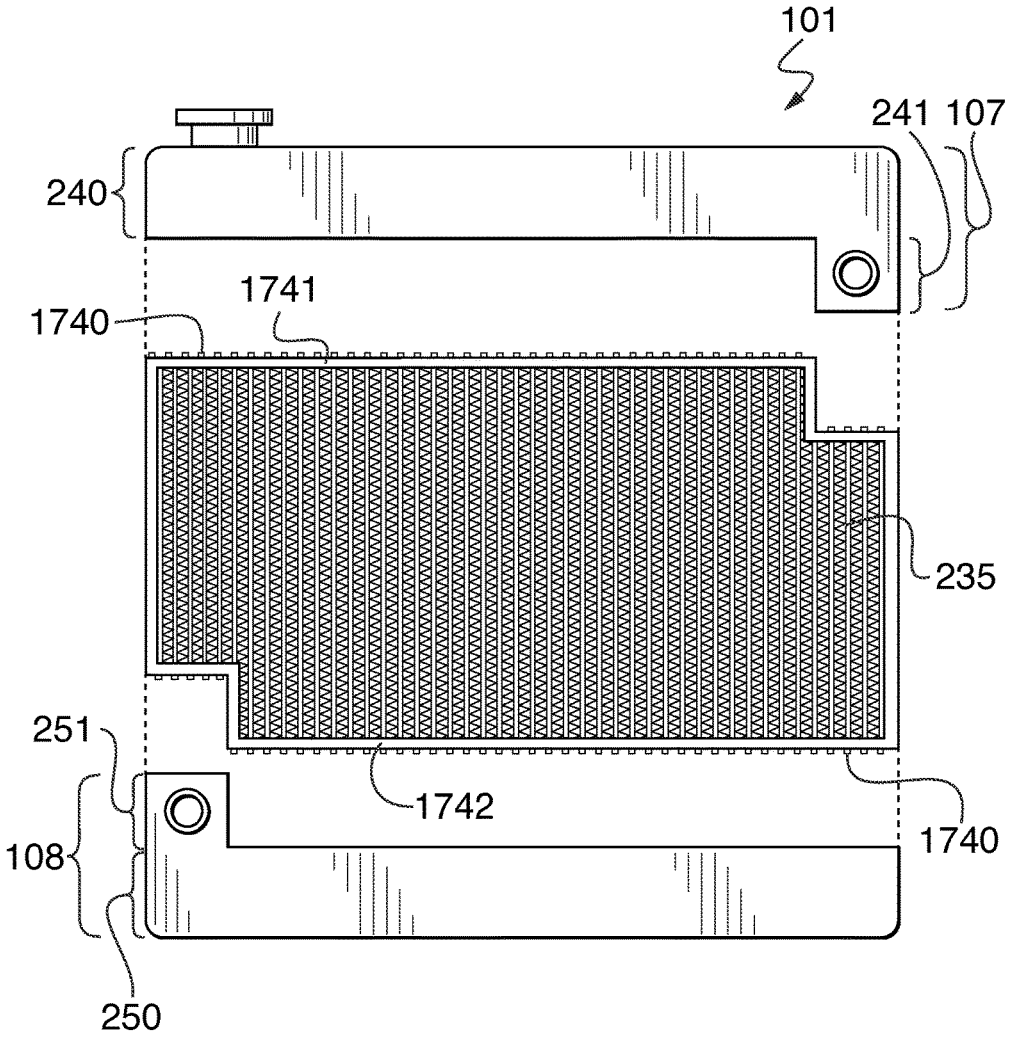
FIG. 18 is a front exploded view of primary radiator having a down-flow configuration according to an embodiment.

FIG. 18 is a front exploded view of primary radiator 101 having a down-flow configuration according to an embodiment. FIG. 18 depicts the relationship between the stepped tanks 107 and 108 and the radiator core 235.

The present cooling system can be designed to accommodate any type of radiator including a double cross-flow radiator configuration such as that shown in FIGS. 19 and 20. FIG. 19 is an engine side view of a supplemental radiator 1902 having a double pass cross-flow configuration according to an embodiment. As shown in FIG. 19 the supplemental radiator 1902, comprising a supplemental inlet tank 1935 and the supplemental outlet tank 1936 can be located on a single side of the supplemental radiator core 137. The coolant can flow into the supplemental backside inlet 1922 from the primary radiator (shown in FIG. 20) and into the supplemental inlet tank 1935. The double pass cross-flow configuration for the supplemental radiator 1902 can have a supplemental top radiator core 1950 and a supplemental bottom radiator core 1951. The coolant from the supplemental inlet tank 1935 can travel across the supplemental top radiator core 1950 and into a supplemental collection tank 1952. The coolant can then flow from the supplemental collection tank 1952 across the supplemental bottom radiator core 1951 and into the supplemental outlet tank 1936 prior to exiting the supplemental radiator 102 through the supplemental backside outlet 123. FIG. 20 is a front side view of a primary radiator 1901 having a double pass cross-flow configuration according to an embodiment. As shown in FIG. 20, coolant can enter the primary radiator 1901 from the engine (not shown) through the primary engine side inlet 1905 and fill the primary inlet tank 1907. The primary inlet tank 1907 can have the upper tank 1940 and the lower tank 1941. The upper tank 1941 can comprise the primary front side outlet 1909. In an embodiment, coolant from the primary inlet tank 1907 can either flow into the primary radiator core 2035 or out the primary front side outlet 1909 to the secondary radiator 1902 (not shown in FIG. 20).

The primary radiator core 2035 in the double pass cross-flow configuration can comprise a primary top radiator core 2060 and a primary bottom radiator core 2061. The coolant that does not exit the primary radiator 101 can flow across the primary top radiator core 2060 and into a primary collection tank 2062. The coolant can then flow from the primary collection tank 2062 across the primary bottom radiator core 2061. According to an embodiment, he coolant from the primary bottom radiator core 2061 can then combine with the coolant returning from the supplemental radiator 1902 (not pictured) within the primary outlet tank 1908. The coolant returning from the supplemental radiator 1902 can enter the primary tank 1901 through the primary front side inlet 1910 into the lower tank 251 and return to the engine through the primary engine side outlet 1906.

Figure 21:
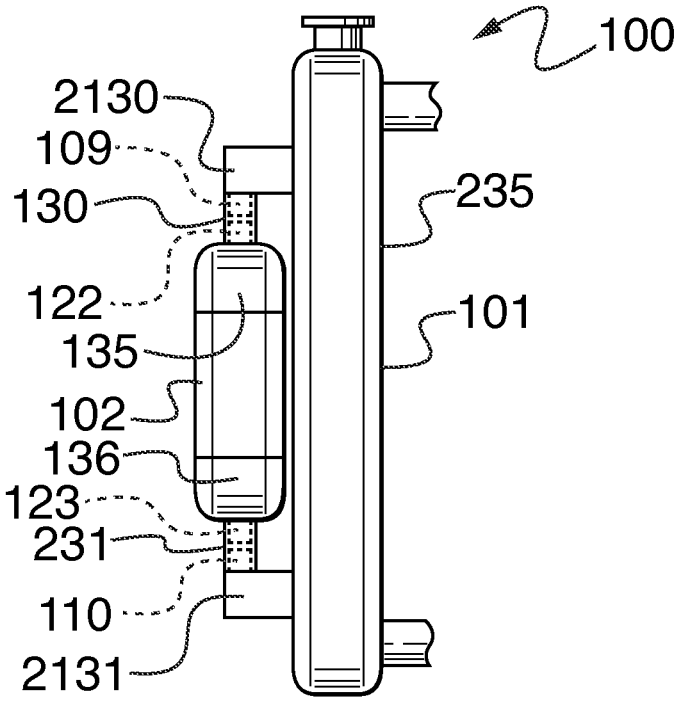
FIG. 21 is a side view of a cooling system comprising a primary radiator and a supplemental radiator, each radiator connected to the other by an alternate style of ports and hoses according to an alternative embodiment.

FIG. 21 is a side view of a cooling system comprising a primary radiator 101 and a supplemental radiator 102, each radiator connected to the other by an alternate style of ports and hoses according to an alternative embodiment. The primary radiator 101 shown in FIG. 21, can be identical to the primary radiator 101 shown in FIG. 8. A possible alternative design can comprise a front side inlet 110 that can be connected to an inlet tank extension 2130 of the inlet stepped section 241 of the inlet radiator tank 107. The front side inlet 110 can be located on the bottom inlet tank extension 2130, which can allow the first piece of tubing 130 to be attached parallel to one or more radiators 101 or 102 comprising the cooling system 100. The alternative embodiment can also comprise a front side outlet 109 that can be connected to an outlet tank extension 2131 of the outlet stepped section 251 of the outlet radiator tank 108. The front side outlet 109 can be located on the top inlet tank extension 2131, which can allow the second piece of tubing 231 to be attached parallel to one or more radiators 101 or 102 comprising the cooling system 100.

As part of a possible alternative embodiment the supplemental radiator 102 can comprise a secondary backside inlet 122 that can be located on the top surface of the inlet tank 135 of the supplemental radiator 102. The supplemental backside outlet 123 can be located on the bottom of the outlet tank 136 of the supplemental radiator 102. The locations of the supplemental backside inlet 122 and supplemental backside outlet 123 can allow the supplemental radiator 102 to be located between the inlet tank extension 2130 and the outlet tank extension 2131 of the primary radiator 101. This design can save space and allow the primary radiator 101 and one or more supplemental radiators 102 to be located in places within the engine compartment that having tight space requirements. One or more inlets or outlet 109, 110, 122 or 123 can comprise these alternative designs so that the cooling system 100 can be adapted to any style vehicle.

In addition to the alternative embodiments shown, the present system can work with two different types of radiators for the primary 101 and supplemental radiators 102, such as the primary radiator 101 being a down-flow style radiator and the supplemental radiator 102 being a cross-flow style radiator, or any other combinations known in the art of radiator construction.

Although the present cooling system has been described in terms of exemplary embodiments, none is limited thereto. Rather, the appended claims should be construed broadly, to include other variants and embodiments of the present device and method, which may be made by those skilled in the art without departing from the scope and range of equivalents of either the device or method.

What is claimed is:

1. A cooling system, comprising:

a primary radiator, located proximate to an engine, having an engine-side, which is the side of the primary radiator closest to the engine and a front-side, which is the side of the primary radiator opposite the engine-side of the primary radiator;

the primary radiator comprising an upper stepped tank, comprising a stepped section and a non-stepped section, wherein the stepped section of the upper stepped tank is wider than the non-stepped section, the upper stepped tank located at the top of the primary radiator, the upper stepped tank comprising an engine-side inlet, located at the stepped section and on the engine-side of the primary radiator, and a front-side outlet, also located at the stepped section and on the front-side of the primary radiator, and a lower stepped tank, comprising a stepped section and a non-stepped section, wherein the stepped section of the lower stepped tank is wider than the non-stepped section, the lower stepped tank located at the bottom of the primary radiator, the stepped section of the lower stepped tank comprising a front-side inlet and an engine-side outlet, both located at the stepped section of the lower stepped tank, and a radiator core, the radiator core cutout in a stepped shape configured to be joined to both the stepped section of the upper stepped tank and the stepped section of the lower stepped tank and connected, physically and fluidically, to the upper stepped tank and the lower stepped tank, wherein the radiator core comprises a plurality of ports fluidically connecting the upper stepped tank and the lower stepped tank;

a supplemental radiator, facing the front-side of the primary radiator and located away from the engine-side of the primary radiator, having an upper side located at the top of the supplemental radiator and a lower side located at the bottom of the supplemental radiator, the supplemental radiator comprising an upper supplemental tank located at the upper side of the supplemental radiator, the upper supplemental tank comprising an upper supplemental tank inlet, facing the front-side of the primary radiator and located opposite the front-side outlet of the upper stepped tank of the primary radiator, the supplemental radiator also comprising a lower supplemental tank located at the lower side of the supplemental radiator, the lower supplemental tank comprising a lower supplemental tank outlet facing the front-side of the primary radiator and located opposite the front-side inlet of the lower stepped tank of the primary radiator, and the supplemental radiator also comprising a supplemental core connected, physically and fluidically, to the upper supplemental tank and the lower supplemental tank;

a first hose fluidically connecting the front-side outlet of the primary radiator to the upper supplemental tank inlet; and a second hose fluidically connecting the front-side inlet of the primary radiator to the lower supplemental tank outlet.

2. The cooling system described in claim 1 wherein the primary radiator is a down-flow radiator.

3. The cooling system described in claim 1 wherein the supplemental radiator is a down-flow radiator.

4. The cooling system described in claim 1 wherein the first hose comprises a manual control valve.

5. The cooling system described in claim 1 wherein the first hose comprises an automatic control valve.

6. The cooling system described in claim 1 wherein the supplemental radiator is a double down-flow regulator.

7. The cooling system described in claim 1, wherein the supplemental radiator further comprises an upper supplemental tank outlet and a lower supplemental tank inlet, and further comprising a tertiary radiator comprising an upper tertiary tank, the upper tertiary tank comprising an upper tertiary tank inlet, a lower tertiary tank, the lower tertiary tank comprising a lower tertiary tank outlet, and a tertiary core connected, physically and fluidically, to the upper tertiary tank and the lower tertiary tank;

a third hose fluidically connecting the upper supplemental tank outlet of the supplemental radiator to the upper tertiary tank inlet; and a fourth hose fluidically connecting the lower supplemental tank inlet of the supplemental radiator to the lower tertiary tank outlet.

8. The cooling system described in claim 1, further comprising a radiator shroud, wherein the radiator shroud physically connects the primary radiator to the secondary radiator.

9. The cooling system described in claim 8, further comprising a fan, wherein the fan pushes air over the core of the supplemental radiator and into the radiator shroud.

10. The cooling system described in claim 8, further comprising an internal fan located within the radiator shroud, wherein the internal fan directs airflow through the supplemental radiator and then through the primary radiator.

11. A cooling system, comprising:

a primary cross-flow radiator, located proximate to an engine, having an engine-side, which is the side of the primary cross-flow radiator closest to the engine and a front-side, which is the side of the primary cross-flow radiator opposite the engine-side of the primary cross-flow radiator;

the primary cross-flow radiator comprising a stepped cross-flow outlet tank comprising a stepped section and a non-stepped section, wherein the stepped section of the stepped cross-flow outlet tank is wider than the non-stepped section, and a stepped cross-flow inlet tank, comprising a stepped section and a non-stepped section, wherein the stepped section of the stepped cross-flow inlet tank is wider than the non-stepped section, the stepped cross-flow inlet tank comprising an engine-side inlet, located on the engine-side of the primary cross-flow radiator, and a front-side outlet, located at the stepped section and on the front-side of the primary cross-flow radiator, and the stepped cross-flow outlet tank comprising a front side inlet, located at the stepped section and on the front-side of the primary cross-flow radiator and an engine-side outlet, located on the engine-side of the primary cross-flow radiator, and a cross-flow radiator core, the cross-flow radiator core cutout in a stepped shape configured to be joined to both the stepped sections of the cross-flow outlet tank and the stepped section of the cross-flow inlet tank and connected, physically and fluidically, to the stepped cross-flow outlet tank and the stepped cross-flow inlet tank, wherein the cross-flow radiator core comprises a plurality of ports fluidically connecting the cross-flow outlet tank and the cross-flow inlet tank;

a supplemental cross-flow radiator, facing the front-side of the primary cross-flow radiator and located away from the engine-side of the primary cross-flow radiator, comprising a cross-flow supplemental outlet tank comprising a supplemental outlet tank outlet, facing the front-side of the primary cross-flow radiator and located opposite the front-side inlet of cross-flow supplemental outlet tank of the primary cross-flow radiator, and a cross-flow supplemental inlet tank comprising a supplemental inlet tank inlet, facing the front-side of the primary cross-flow radiator and located opposite the front-side outlet of the cross-flow inlet tank of the primary cross-flow radiator, and a supplemental cross-flow core connected, physically and fluidically, to the cross-flow supplemental outlet tank and the crossflow supplemental inlet tank;

a first hose fluidically connecting the front-side outlet of the primary cross-flow radiator to the supplemental inlet tank inlet of the supplemental cross-flow radiator; and a second hose fluidically connecting the front-side inlet of the primary cross-flow radiator to the supplemental outlet tank outlet of the supplemental cross-flow radiator.

12. The cooling system described in claim 11 wherein the first hose comprises a manual control valve.

13. The cooling system described in claim 11 wherein the first hose comprises an automatic control valve.

14. The cooling system described in claim 11 wherein the supplemental cross-flow radiator is a double cross-flow radiator.

15. The cooling system described in claim 11, wherein the supplemental cross-flow inlet tank of the supplemental cross-flow radiator further comprises a supplemental cross-flow tank outlet and the supplemental cross-flow outlet tank of the supplemental cross-flow radiator further comprises a supplemental cross-flow tank inlet, the cooling system further comprising a tertiary crossflow radiator comprising a tertiary cross-flow inlet tank, the tertiary cross-flow inlet tank comprising a tertiary cross-flow tank inlet, a tertiary cross-flow outlet tank, the tertiary cross-flow outlet tank comprising a tertiary cross-flow tank outlet, and a tertiary cross-flow core connected, physically and fluidically, to the tertiary crossflow inlet tank and the tertiary cross-flow outlet tank;

a third hose fluidically connecting the supplemental cross-flow tank outlet of the supplemental cross-flow radiator to the tertiary cross-flow tank inlet; and a fourth hose fluidically connecting the supplemental cross-flow tank inlet of the supplemental cross-flow radiator to the tertiary cross-flow tank outlet.

16. The cooling system described in claim 11, further comprising a radiator shroud, wherein the radiator shroud physically connects the primary cross-flow radiator to the supplemental cross-flow radiator.

17. The cooling system described in claim 16, further comprising a fan, wherein the fan pushes air over the supplemental cross-flow core of the supplemental cross-flow radiator and into the radiator shroud.

18. The cooling system described in claim 16, further comprising an internal fan located within the radiator shroud, wherein the internal fan directs airflow through the supplemental cross-flow radiator and then through the primary cross-flow radiator.

19. A method for using a cooling system, the method comprising:

providing the cooling system, comprising: a primary radiator, having an engine-side, which is the side of the primary radiator closest to an engine and a front-side, which is the side of the primary radiator opposite the engine-side of the primary radiator; the primary radiator comprising an upper stepped tank, comprising a stepped section and a non-stepped section, wherein the stepped section of the upper stepped tank is wider than the non-stepped section, the upper stepped tank located at the top of the primary radiator, the stepped section of the upper stepped tank comprising an engine-side inlet, located on the engine-side of the primary radiator and a front-side outlet, located on the front-side of the primary radiator, and a lower stepped tank, comprising a stepped section and a non-stepped section, wherein the stepped section of the lower stepped tank is wider than the non-stepped section, the lower stepped tank located at the bottom of the primary radiator, the stepped section of the lower stepped tank comprising a front-side inlet and an engine-side outlet, and a radiator core, the radiator core cutout in a stepped shape configured to be joined to both the stepped section of the upper stepped tank and the stepped section of the lower stepped tank and connected, physically and fluidically, to the upper stepped tank and the lower stepped tank, wherein the radiator core comprises a plurality of ports fluidically connecting the upper stepped tank and the lower stepped tank; a supplemental radiator, facing the front-side of the primary radiator and located away from the engine-side of the primary radiator, having an upper side located at the top of the supplemental radiator and a lower side located at the bottom of the supplemental radiator, the supplemental radiator comprising an upper supplemental tank, located at the upper side of the supplemental radiator, the upper supplemental tank comprising an upper supplemental tank inlet, facing the front-side of the primary radiator and located opposite the front-side outlet of the upper stepped tank of the primary radiator, the supplemental radiator also comprising a lower supplemental tank located at the lower side of the supplemental radiator, the lower supplemental tank comprising a lower supplemental tank outlet facing the front-side of the primary radiator and located opposite the front-side inlet of the lower stepped tank of the primary radiator, and the supplemental radiator also comprising a supplemental core connected, physically and fluidically, to the upper supplemental tank and the lower supplemental tank; a first hose fluidically connecting the front-side outlet of the primary radiator to the upper supplemental tank inlet; and a second hose fluidically connecting the front-side inlet of the primary radiator to the lower supplemental tank outlet;

providing and locating the engine on the engine side of the primary radiator, the engine comprising a coolant inlet configured to allow a coolant to flow into the engine and a coolant outlet configured to allow the coolant to flow out from the engine to be cooled by air;

providing the coolant;

fluidically connecting the coolant outlet of the engine to the engine-side inlet of the upper stepped tank of the primary radiator and fluidically connecting the engine-side outlet of the lower stepped tank of the primary radiator to the coolant inlet of the engine;

circulating the coolant from the engine, through the coolant outlet of the engine, into the upper stepped tank of the primary radiator, through the engine-side inlet of the primary radiator, from the upper stepped tank of the primary radiator through the front side outlet of the primary radiator into the upper supplemental tank of the supplemental radiator, through the supplemental core to the lower supplemental tank, through the lower supplemental tank outlet and into the front-side inlet of the lower stepped tank of the primary radiator and from the lower stepped tank of the primary radiator into the coolant inlet of the engine through the engine-side outlet of the lower stepped tank of the primary radiator.

* * * * *